United States Patent [19]

Juhola

[11] 4,449,848

[45] May 22, 1984

[54] MEANS FOR PROVIDING A VERTICAL DRAIN IN SOIL

[76] Inventor: Mauno O. Juhola, Lounaisväylä 2, 00200 Helsinki 20, Finland

[21] Appl. No.: 465,045

[22] Filed: Feb. 9, 1983

[51] Int. Cl.[3] ..... E02D 3/10

[52] U.S. Cl. ..... 405/50; 52/158; 405/36

[58] Field of Search ..... 405/50, 36; 166/212; 175/267, 269; 52/158

[56] References Cited

U.S. PATENT DOCUMENTS

| | | | |
|---|---|---|---|
| 2,724,441 | 11/1955 | Rogers | 166/212 |
| 2,765,854 | 10/1956 | Lewis | 166/212 X |
| 2,970,651 | 2/1961 | Roberts | 166/212 |
| 3,055,424 | 9/1962 | Allen | 166/212 X |
| 3,478,524 | 11/1969 | Hoppe | 405/50 |
| 4,166,508 | 9/1979 | Berg | 405/50 X |

*Primary Examiner*—Dennis L. Taylor

[57] ABSTRACT

Means for providing a vertical drain in soil, comprising a push tube to be pushed into the soil and which carries within itself a prefabricated drain provided with a plate-like anchor on the lower end, and which anchor rests against the lower end of the push tube, and keeps the prefabricated drain in its place when the push tube is pulled upwards. The difficulty lies in making sure that the anchor and the prefabricated drain really remain stationary also in soft soil. As taught by the invention, the lower end of the push tube is provided with at least one pouch-like pressure member located between said push tube and the anchor and inflatable by the aid of a pressurized fluid so that it will push the anchor off the lower end of the push tube and spread it out in an opened position.

2 Claims, 3 Drawing Figures

MEANS FOR PROVIDING A VERTICAL DRAIN IN SOIL

Figure 1:
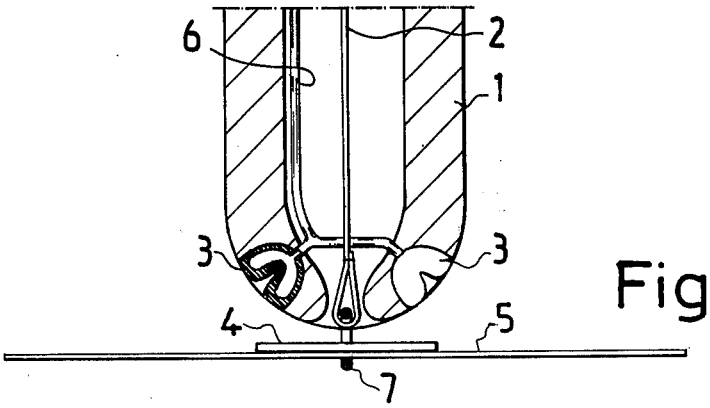

The present invention is applied when prefabricated drains are used for consolidating water-carrying, fine-grained soil with low water permeability, such as clay, silt, etc., by dewatering the soil draining it vertically and thus reducing the water content of the soil matter. The bearing capacity of the ground will in this way be improved, settlings expected to take place are accelerated, while the shearing strength of the soil also increases.

For purposes of vertical draining, various prefabricated drains have been developed, e.g. drains made of profiled, about 10 cm wide plastic strip material and of porous paper or similar water-permeable filtering material wound around the strip.

A vertical drain is established in the soil by pushing it by means of a particular push tube down to desired depth, veritcally as a rule. The prefabricated drain is located within the push tube, and the lower end of the prefabricated drain is anchored by means of a particular anchor in its place. On completed installation, the push tube is pulled out, whereby the prefabricated drain remains in the soil. The prefabricated drain is cut off at a suitable height. Depending on the soil bottom conditions, and the aims, prefabricated drains of this type are disposed with a suitable spacing, for instance at intervals of 1–2 meters on the area to be consolidated. Water from the soil drains through the porous paper into channels in the prefabricated drain, wherefrom it ascends and runs off.

By vertically draining, it is also possible to dewater and consoidate a clay or mud layer, with a thickness which may be tens of metres, on the bottom of a sea or lake. Vertical draining is necessary when a particular site on the sea or lake bottom is designed to be filled e.g. for building a road, railway or even an air field. If the soft, compressible clay or mud layer is not drained vertically before filling, it takes tens of years before the compressible layers settle by effect of the filling and other loads applied on top of them. By draining vertically, the settling can be accelerated to take place in a year or two, or even in a few months' time, depending on the conditions on the bottom and on the spacing of the vertical drains. The amount of the settlements may be up to several metres, depending on the bottom conditions and loads.

Therefore, the object of the present invention is a means for providing a vertical drain in soil, comprising a push tube to be pushed into the soil, carrying along with it a prefabricated drain provided with a plate-like anchor on its lower end, this anchor resting against the lower end of the push tube and, when the push tube is being pulled back upwards, keeps the prefabricated drain in its place.

Up to date, difficulties have been encountered in ensuring the retention of the anchor on the lower end of the prefabricated drain, and thus also of the prefabricated drain, in their places when the push tube is being pulled upwards. Difficulties have in particular been experienced in those cases in which prefabricated draining has been required in so-called "quick clay". This is due to the fact that in connection with the piercing of the filling upon the ground, the anchor plate is bent against the lower end of the push tube. Thus, when the push tube is being pulled upwards in such quick clay, the anchor plate will not sitck in the clay and will instead rise up with the push tube.

The object of the invention is to eliminate the drawback mentioned in the foregoing and to ensure the sticking of the anchor plate also in quick clay. The invention is characterized in that the lower end of the push tube is provided with at least one ponch-like pressure member located between the lower end and the anchor and which can be inflated by the aid of a pressurized fluid so that it pushes the anchor off the lower end of the push tube and spreads it out in fully opened position. Hereby, the surface of the anchor which attaches to the adjacent soil becomes substantially larger so that the anchor plate will be positively retained in its place when the push tube is pulled up.

The invention is described in the following with the aid of an example, referring to the drawing attached, wherein FIG. 1 presents the lower end of the push tube in section, with the anchor attached to the lower end of the prefabricated drain.

Figure 2:
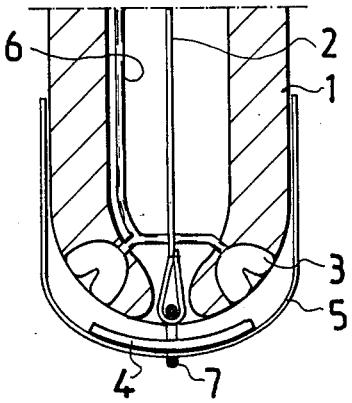

FIG. 2 presents the lower end of the prefabricated drain after it has been pushed into the soil and the anchor has become bent against the lower end of the push tube.

Figure 3:
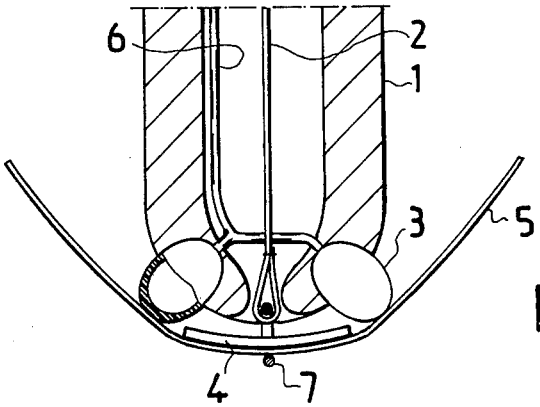

FIG. 3 presents the push tube in its lowered position with the anchor spread out.

The reference numeral 1 in the drawing refers to the lower end of the push tube, carrying the prefabricated drain 2 within itself. To the lower end of the prefabricated drain 2 has been connected, by the aid of a loop 7 and a connecting piece, or supporting plate 4, a plate-like anchor 5.

As taught by the invention, the lower end of the push tube 1 carries two pouch-like pressure members 3, disposed between the lower end of the push tube and the anchor 5. The pouch-like pressure members 3 communicate by a passage 6 with a source of pressurized fluid above ground. By the aid of the pressurized fluid, the pressure members can be inflated to assume the position depicted in FIG. 3, whereby the anchor 5 is spread out.

FIG. 1 presents the situation in which the push tube 1 is in its upper position, and the anchor plate 5 and the support plate 4 have been attached to the lower end of the prefabricated drain 2 by the aid of a loop 7. FIG. 2 presents the situation in which the push tube 1 has penetrated into the soil and the anchor plate 5 has been bent against the lower end of the push tube. FIG. 3 presents the situation in which the push tube 1 is in its lowered position. The pouch-like pressure members 3 have been filled with pressurized fluid so that they have been inflated to project and have pushed the anchor 5 off the lower end of the push tube and spread it into opened position. Now, when the push tube 1 is pulled up, the anchor 5 will adhere positively to the surrounding soil even if this happens to be quick clay or another soft soil constituent. The pressure is released from the pressure members 3, whereby they retract into the position depicited in FIGS. 1 and 2.

It is obvious to a person skilled in the art that different embodiments of the invention may vary within the scope of the claims stated below. For instance, the functioning of the pouch-like pressure members 3 may be brought about either hydraulically or pneumatically. The number of pouch-like pressure members 3 may vary. It is advantageous if their number is even and if they are symmetrically located with reference to the axis of the push tube 1. Uniform spreading of the anchor 5 is hereby achieved.

I claim:

1. Improvement in a means for providing a vertical drain in soil, comprising a push tube to be pushed into the soil and which carries within itself a prefabricated drain provided with a plate-like anchor on the lower end, said anchor resting against the lower end of the push tube and keeping the prefabricated drain stationary while the push tube is pulled upwards, wherein the improvement comprises that the lower end of the push tube is provided with at least one pouch-like pressure member located between said push tube and the anchor and which can be inflated by the aid of a pressurezed fluid so that it will push the anchor off the lower end of the push tube and spread it out in opened position.

2. Means according to claim 1, characterized in that the number of pouch-like pressure members is an even number and that they are located symmetrically in relation to the axis of the push tube.

* * * * *